US009993916B2

(12) United States Patent
Chen et al.

(10) Patent No.: US 9,993,916 B2
(45) Date of Patent: Jun. 12, 2018

(54) MULTI-PURPOSE ELECTRIC TOOL AND CONTROL THEREOF

(71) Applicant: CHERVON INTELLECTUAL PROPERTY LIMITED, Road Town (VG)

(72) Inventors: Liang Chen, Nanjing (CN); Wu Chen, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 868 days.

(21) Appl. No.: 14/491,529

(22) Filed: Sep. 19, 2014

(65) Prior Publication Data

US 2015/0122521 A1 May 7, 2015

(30) Foreign Application Priority Data

Nov. 4, 2013 (CN) ..... 2013 1 0538859

(51) Int. Cl.
*B25B 21/02* (2006.01)
*B25F 5/00* (2006.01)
*B25B 23/147* (2006.01)

(52) U.S. Cl.
CPC ..... *B25F 5/001* (2013.01); *B25B 21/02* (2013.01); *B25B 23/1475* (2013.01)

(58) Field of Classification Search
CPC ..... B25F 5/001; B25F 21/02; B25F 23/1475
USPC ..... 173/170, 93
See application file for complete search history.

(56) References Cited

U.S. PATENT DOCUMENTS

2012/0169256 A1* 7/2012 Suda ..... B25B 21/00 318/17

* cited by examiner

*Primary Examiner* — Michelle Lopez
(74) *Attorney, Agent, or Firm* — Greenberg Traurig, LLP

(57) ABSTRACT

A multi-purpose electric tool has a motor, an impact block, a detection assembly configured to detect the position and the movement state of the impact block, and a main control circuit board configured to control whether the motor is powered off upon reaching a preset state according to the detected information of the detection assembly. In the control method, the detection assembly feeds back the detected information to the main control circuit board, if the impact block is not impacting reciprocatingly, the main control circuit board performs torque control according to whether the preset state is reached; and if the impact block is impacting reciprocatingly, the main control circuit board enables the motor to output in a normal mode which does not limiting the current.

6 Claims, 4 Drawing Sheets

MULTI-PURPOSE ELECTRIC TOOL AND CONTROL THEREOF

RELATED APPLICATION INFORMATION

This application claims the benefit of CN 201310538859.3, filed on Nov. 4, 2013, the disclosure of which is incorporated herein by reference in its entirety.

FIELD OF THE DISCLOSURE

The present disclosure relates to an electric tool and a control method thereof, and more particularly to a multi-purpose electric tool and a control method thereof.

BACKGROUND OF THE DISCLOSURE

Current electric tools for outputting torque include two types: one type is used to output torque continuously, for example, electric drills and ordinary screwdrivers, and the other type is used to output torque in an intermittent impact manner, for example, impact screwdrivers. The structures of the two types of tools usually vary with their functions.

Currently there is a multi-purpose electric tool integrating two torque outputting modes, i.e., it may be used either as an electric drill or ordinary screwdriver, or as an impact screwdriver. However, the current multi-purpose electric tool, as an ordinary screwdriver, usually needs to be provided with a mechanism capable of achieving toque control, such as a torque clutch mechanism, which causes drawbacks such as necessitating a relatively larger machine body and relatively higher costs.

SUMMARY OF THE DISCLOSURE

To overcome the drawbacks in the prior art, an object of the present disclosure is to provide a multi-purpose electric tool and a control method thereof, which achieves torque control through electronic control.

To achieve the above object, the present disclosure employs the following technical solution:

A multi-purpose electric tool comprises a housing, a motor and a transmission mechanism driven by the motor, wherein the transmission mechanism comprises an input shaft directly or indirectly driven by the motor to rotate, an impact block which rotates coaxially and synchronously only along with the input shaft when locked at a first axial position and which rotates coaxially and synchronously along with the input shaft as well as moves reciprocatingly between the first axial position and a second axial position in the axial direction when unlocked, an output shaft driven by the impact block at the first axial position to rotate synchronously, and a locking assembly capable of locking or unlocking the impact block. The multi-purpose electric tool additionally comprises a detection assembly configured to detect the position and the movement state of the impact block, and a main control circuit board configured to control whether the motor is powered off upon reaching a preset state according to the detected information of the detection assembly, wherein the detection assembly is electrically connected to the main control circuit board.

Furthermore, the impact block is at least provided with a receiving hole extending radially with a limiting step being formed inside the receiving hole, the input shaft being at least provided with a locking hole corresponding to the receiving hole in the circumferential and axial positions, wherein the locking assembly at least comprises: a locking pin arranged in the receiving hole and being movable in the radial direction, a limiting ring sleeved around the outer circumference of the impact block and limiting the locking pin, a spiral spring sleeved around the outer circumference of the locking pin and enabling the locking pin to move away from the input shaft, and an operating member which presses the locking pin partly into the locking hole or loosens the locking pin to allow it to completely retract out of the locking hole by its own movement; wherein one end of the locking pin forms a semi-spherical nosetip and a limiting step against which the spiral spring abuts is provided inside the nosetip, the limiting ring being provided with a through hole which enables the semi-spherical nosetip of the locking pin to pass there through and blocks the limiting step of the locking pin, both ends of the spiral spring respectively abutting against the limiting step of the receiving hole and the limiting step of the locking pin, wherein the operating member and the housing form a sliding connection parallel to the axial direction, the operating member comprising a press ring capable of pressing the locking pin, a connection bridge capable of loosening the locking pin to allow it to partly protrude out of the limiting ring, and a push button to be pushed or pulled by an operator's hand from the outside of the housing.

Furthermore, the detection assembly may at least comprise a Hall element.

Furthermore, the detection assembly may comprise one or more of a photoelectric sensor, a position switch and a sound pick-up device.

Furthermore, the preset state of the motor preferably means that the current of the motor reaches a preset current value.

Furthermore, the electric tool may further comprise an operation device configured to, by selecting a stage, set a preset parameter in the main control circuit board as a criterion for judging whether the preset state is reached, and the operation device is electrically connected to the main control circuit board.

A multi-purpose electric tool may also comprise a motor, an impact block, a detection assembly configured to detect the position and the movement state of the impact block, and a main control circuit board configured to control whether the motor is powered off upon reaching a preset state according to the detected information of the detection assembly, wherein the detection assembly is electrically connected to the main control circuit board.

Furthermore, the detection assembly may at least comprise a Hall element.

Furthermore, the detection assembly may comprise one or more of a photoelectric sensor, a Hall element, a position switch and a sound pick-up device.

Furthermore, the above electric tool may further comprise an operation device configured to, by selecting a stage, set a preset parameter in the main control circuit board as a criterion for judging whether the preset state is reached, and the operation device is electrically connected to the main control circuit board.

Furthermore, the preset state of the motor preferably means that the current of the motor reaches a preset current value.

A control method for a multi-purpose electric tool, the multi-purpose electrical tool comprising a motor, an impact block, a detection assembly configured to detect the position and the movement state of the impact block, and a main control circuit board configured to control whether the motor is powered off upon reaching a preset state according to a detected information of the detection assembly, wherein the detection assembly is electrically connected to the main control circuit board; and wherein in the control method, the detection assembly feeds back the detected information to the main control circuit board, if the impact block is not impacting reciprocatingly, the main control circuit board performs torque control according to whether the preset state is reached, and if the impact block is impacting reciprocatingly, the main control circuit board does not perform torque control according to the preset state.

Furthermore, the preset state of the motor preferably means that the current of the motor reaches a preset current value.

Furthermore, when the preset state takes the preset current value as a judgment parameter, the control method may comprise the following steps:

(a) starting;

(b) detecting the current of the motor by the main control circuit board;

(c) judging the detected current value of the motor by the main control circuit board, if the detected current value is greater than a first current threshold, step (d) is performed; and if the detected current value is smaller than the first current threshold, returning to step (b);

(d) judging the detected information of the detection assembly by the main control circuit board, if the detected information indicates that the impact block is not impacting reciprocatingly, step (e) is performed; and if the detected information indicates that the impact block is impacting reciprocatingly, returning to step (b);

(e) detecting the current of the motor by the main control circuit board;

(f) judging the detected current value of the motor by the main control circuit board, if the detected current value is greater than a second current threshold, step (g) is performed; and if the detected current value is smaller than the second current threshold, returning to step (c), and the second current threshold is the preset current value;

(g) controlling the motor to power off by the main control circuit board; and (h) ending.

Furthermore, when the impact block is impacting reciprocatingly, and the main control circuit board does not perform torque control according to the preset state, the motor may output in a normal mode which does not limiting the current.

Furthermore, the electric tool controlled by the method may further comprise an operation device configured to, by selecting a stage, set a preset parameter in the main control circuit board as a criterion for judging whether the preset state is reached, and the operation device is electrically connected to the main control circuit board.

Advantages of the subject of the present disclosure are as follows: the detection assembly for detecting the state of the impact block is employed so that the main control circuit board can effectively judge the current torque output mode, and thereby perform precise control for the motor in an electronic control manner to achieve precise control of the output torque when the tool serves as an ordinary screwdriver in a continuous output mode. As compared with the conventional mechanical torque control structure requiring integration of two kinds of torque output modes, the present disclosure performs more accurate control, greatly reduces hardware structure required for achieving the function, effectively reduces the size and weight of the machine body, facilitate the user's operation and reduces the manufacture cost.

DETAILED DESCRIPTION OF PREFERRED EMBODIMENTS

Figure 1:
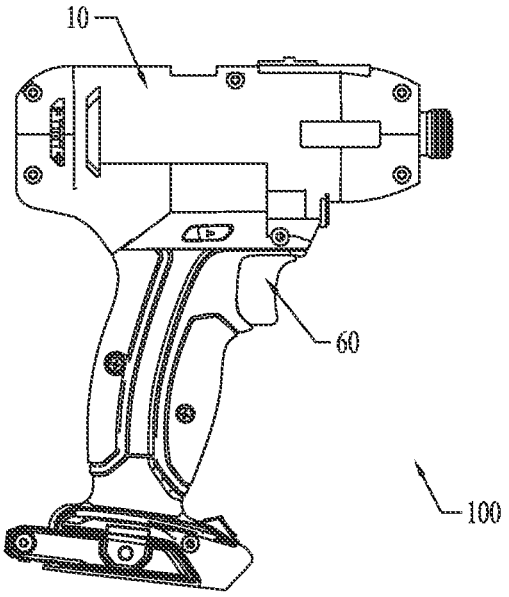
FIG. 1 is a structural schematic view of appearance of an exemplary multi-purpose electric tool constructed according to the present disclosure.
Figure 2:
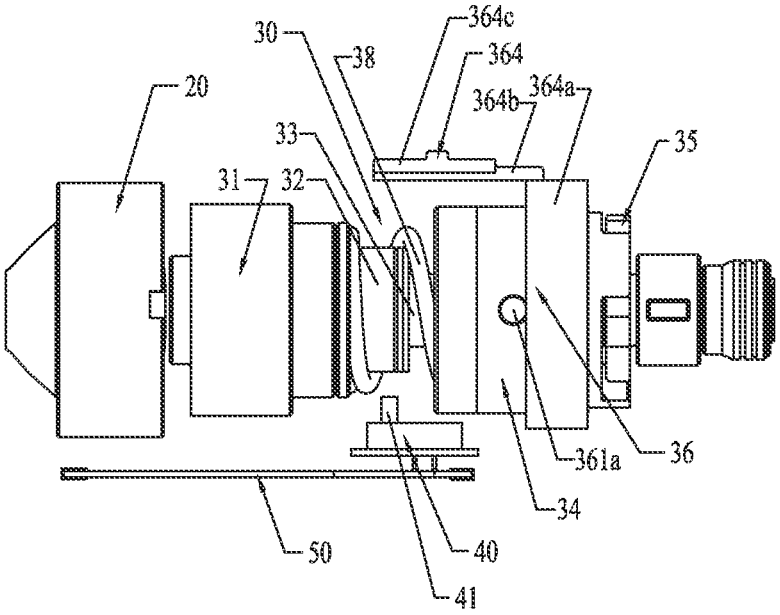
FIG. 2 is a schematic view showing partial internal structures of the device of FIG. 1.
Figure 3:
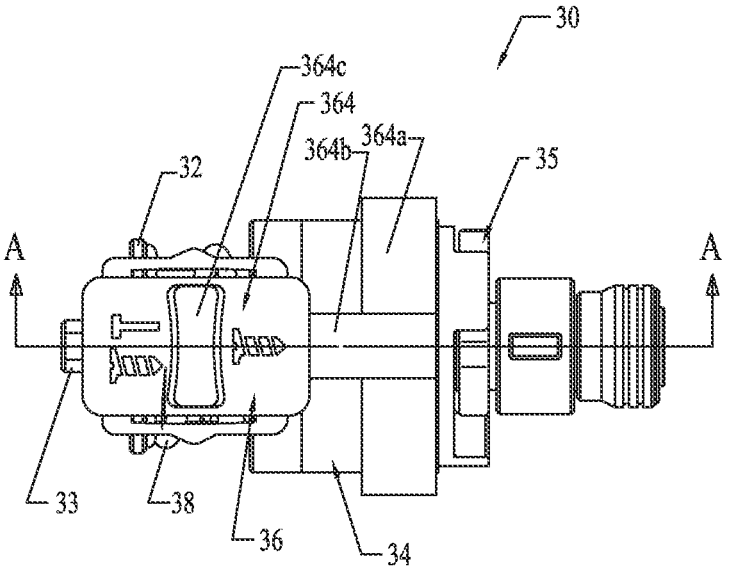
FIG. 3 is a structural schematic view of a portion of the structures shown in FIG. 2 as viewed from another perspective.
Figure 4:
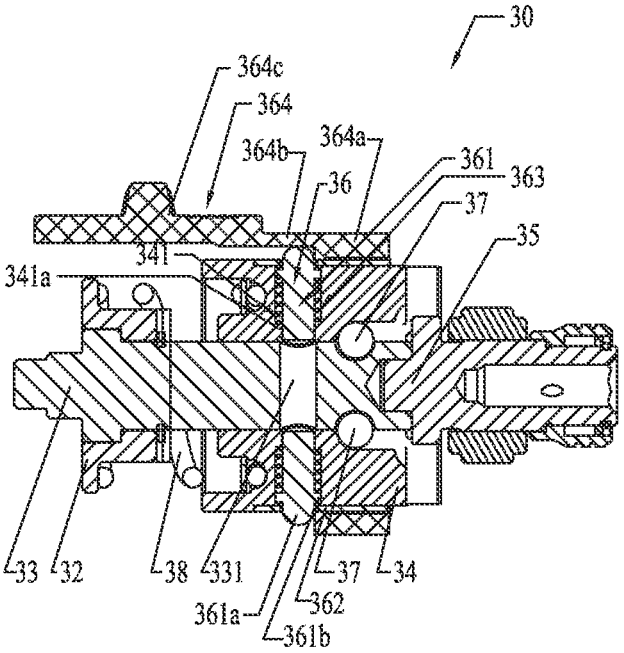
FIG. 4 is a cross sectional view taken along line A-A in FIG. 3.

The present disclosure will be introduced in detail with reference to the figures and specific, exemplary embodiments.

Referring to FIGS. 1-6, the multi-purpose electric tool 100 according to the present disclosure comprises a housing 10, a motor 20, a transmission mechanism 30, a detection assembly 40 and a main control circuit board 50.

Wherein, the motor 20 is arranged in the housing 10, and the transmission mechanism 30 is driven by the motor 20.

Specifically, referring to FIGS. 2-6, the transmission mechanism 30 mainly comprises a gearbox 31, a shaft seat 32, an input shaft 33, an impact block 34, an output shaft 35 and a locking assembly 36.

A motor shaft of the motor 20 transmits power to an input end of the gearbox 31, and an output end of the gearbox 31 transmits power to the shaft seat 32. The input shaft 33 and the shaft seat 32 constitute a circumferential transmission and may rotate together. The impact block 34 is disposed on the input shaft 33, and two steel balls 37 for transmitting torque are provided between the impact block 34 and the input shaft 33. The input shaft 33 and the impact block 34 are both formed with rail slots cooperating with each other to receive the steel balls 37. When the input shaft 33 begins to rotate, the impact block 34 moves axially under action of the steel balls 37 due to the design of the shape of the rail slots and meanwhile is brought by the input shaft 33 to rotate. An axial position of the impact block 34 closest to the output shaft 35 is called a first axial position (the position shown in FIGS. 2, 3, and 4), and an axial position farthest from the output shaft 35 is called a second axial position. Once the input shaft 33 rotates, the impact block 34 moves from the first axial position to the second axial position, whereupon the steel balls 37 serve as a driving force for driving the impact block. When the impact block 34 returns from the second axial position to the first axial position, an elastic member 38 will provide a driving force. The locking assembly 36 can lock or release the axial position of the impact block 34, i.e., lock the impact block 34 at the first axial position or release the impact block 34 to enable it to move between the first axial position and the second axial position.

Figure 5:
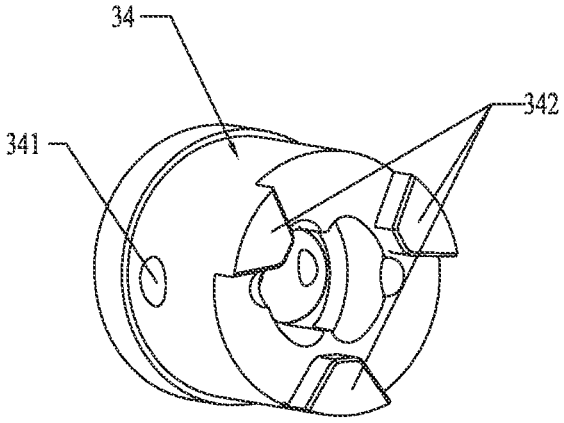
FIG. 5 is a structural schematic view of an exemplary impact block in the device shown in FIG. 1.
Figure 6:
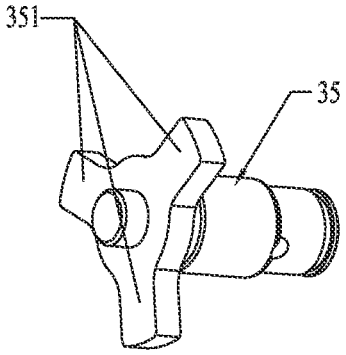
FIG. 6 is a structural schematic view of an exemplary output shaft in the device shown in FIG. 1.

Referring to FIG. 5 and FIG. 6, the impact block 34 is formed with several transmission protrusions 342, and correspondingly the output shaft 35 is formed with several transmission projections 351 each to be positioned between two of the transmission protrusions 342. When the torque is outputted continuously, the transmission protrusions and transmission projections can transfer the torque by continuous contact between them; and when the torque is transmitted in an impact manner, the transmission protrusions and transmission projections transfer the torque through impact between them.

Additionally, one end of the output shaft 35 is disposed in a groove formed at one end of the input shaft 33, but this only enables the rotating of the output shaft 35 to be supported, and there is no torque transmission formed there between The structure of the above transmission mechanism 30 is a current typical transmission structure for impact torque output, and will not be detailed described here.

To meet the objectives set forth above, the impact block 34 is further provided with a receiving hole 341 extending radially, and a limiting step 341*a* is formed inside the receiving hole 341. The input shaft 33 is provided with a locking hole 331 corresponding to the receiving hole 341 in circumferential and axial positions. The locking assembly 36 comprises: a locking pin 361 disposed in the receiving hole 341 and being movable in a radial direction, a limiting ring 362 sleeved disposed around an outer circumference of the impact block 34 and limiting the locking pin 361, a spiral spring 363 sleeved around an outer circumference of the locking pin 361 and enabling it to move away from the input shaft 33, and an operating member 364 which presses the locking pin 361 partly into the locking hole 331 or loosens the locking pin 361 to allow it to completely retract out of the locking hole 331 through its own movement. One end of the locking pin 361 forms a semi-spherical end 361*a*, and a limiting step 361*b* against which the spiral spring 363 abuts is provided inside the end. The limiting ring 362 is provided with a through hole which enables the semi-spherical end 361*a* of the locking pin 361 to pass there through and blocks the limiting step of the locking pin 361. Both ends of the spiral spring 363 respectively abut against the limiting step 341*a* of the receiving hole 341 and the limiting step 361*b* of the locking pin 361. The operating member 364 and the housing 10 (not shown in FIGS. 2, 3 and 4) constitute a sliding connection parallel to the axial direction, which comprises: a press ring 364*a* capable of pressing the locking pin 361, a connection bridge 364*b* capable of loosening the locking pin 361 to allow it partly protrude out of the limiting ring 362, and a push button 364*c* to be pushed or pulled by an operator's hand outside the housing 10.

Upon operation, the user may adjust the position of the operating member 364 to make its press ring 364*a* axially aligned with the receiving hole 341, and the press ring 364*a* presses the locking pin 361 to make the other end thereof embed into the locking hole 331 of the input shaft 33 thereby locking the relative axial positions of the impact block 34 and the input shaft 33. Upon unlocking, the user may adjust the operating member 364 to make a portion of the connection bridge 364*b* that can allow for the retract of the locking pin 361 to align with the receiving hole 341, whereupon the semi-spherical end 361*a* of the locking pin 361 is ejected out under action of the spiral spring 363, and meanwhile the other end thereof also retracts out of the locking hole 331 to achieve unlocking.

It should be noted that the pivotal axes of the shaft seat 32, the input shaft 33, the impact block 34 and the output shaft 35 coincide, that is to say, they have the same pivotal axis. The axial direction, the radial direction and the circumferential direction in the present application all take the pivotal axis as a reference axis.

The detection assembly 40 can detect the position of the impact block 34 and its movement state, and feed back the detected information to a main control circuit board 50. The main control circuit board 50 can control whether the motor 20 is powered off upon reaching a preset state according to the detected information. The detection assembly 40 is electrically connected to the main control circuit board 50.

It should be noted that the preset state is arranged to control the torque, so it should be understood that the motor 20 outputs different torques in different preset states. Additionally, the preset state is not one state, but a plurality of states selected or set by the user, and the preset state may be expressed by a detectable preset parameter, i.e., the preset state is reached when the preset parameter is reached. Preferably, a current value of the motor 20 may be regarded as the preset parameter characterizing the preset state, i.e., the preset state of the motor 20 preferably means that the current value thereof reaches a preset current value.

Certainly, the preset parameter may also be other electrical parameters such as voltage, or duty cycle or physical parameters such as rotation speed or time duration.

As a preferred solution, the detection assembly 40 at least comprises a Hall element 41. In this solution, referring to FIG. 2, the main control circuit board 50 is arranged below the transmission mechanism 30, and the detection assembly 40 is arranged below the input shaft 33. Specifically, this position enables the Hall element 41 to align with a portion of the impact block 34 and thereby achieves the detection of the impact block 34.

As another preferred embodiment, the detection assembly 40 comprises one or more of a photoelectric sensor, a position switch and a sound pick-up device. It should be noted that the position switch here refers to a proximity switch except for a Hall element-based proximity switch, such as a high frequency oscillation proximity switch, an ultrasonic proximity switch, a capacitive proximity switch, a differential coil proximity switch or a permanent magnetic proximity switch.

When the photoelectric sensor is used, the position of the impact block 34 may be detected through an optical signal, whereas when the sound pick-up device is used, the position of the impact block 34 may be detected according to sound differences of the impact block 34 in two states.

As a preferred embodiment, the main control circuit board 50 at least comprises a logic operation element, such as a MCU chip or DSP chip, and a peripheral circuit for supplying power to the main control circuit board 50 and achieving input and output of the signal.

As a preferred embodiment, to provide more options for the user, the multi-purpose electric tool according to the present disclosure further comprises an operation device which is configured to, by selecting a stage, set the preset parameter in the main control circuit board as a criterion for judging whether the preset state is reached, and the operation device is electrically connected to the main control circuit board 50. Furthermore, the operation device comprises an operation panel, a memory and a corresponding circuit device, wherein the operation panel provides a plurality of optional stages for the user. As for the user, these optional stages may be torque stages. After the user selects a certain stage, the operation device can invoke, from the memory, a corresponding parameter as the preset parameter in the main control circuit board 50 so as to achieve the purpose of outputting the torque according to the user's setting.

The control method according to the present disclosure is chiefly based on the multi-purpose electric tool of the present disclosure as introduced above. In the method, the detection assembly 40 feeds back the detected information to the main control circuit board 50. If the impact block 34 does not impact reciprocatingly, the main control circuit board 50 performs torque control according to whether the preset state is reached; and if the impact block 34 is impacting reciprocatingly, the main control circuit board 50 does not perform torque control according to the preset state, whereupon the motor 20 outputs in a normal mode not limiting the current. The so-called normal mode means that the motor 20 operates according to its hardware performance.

Furthermore, the preset state may be achieved by setting the preset parameter of the motor 20, for example, the current value of the motor 20, and the set current value is a preset current value. The preset current value is decided by a torque stage selected by the user on the operation device.

Figure 7:
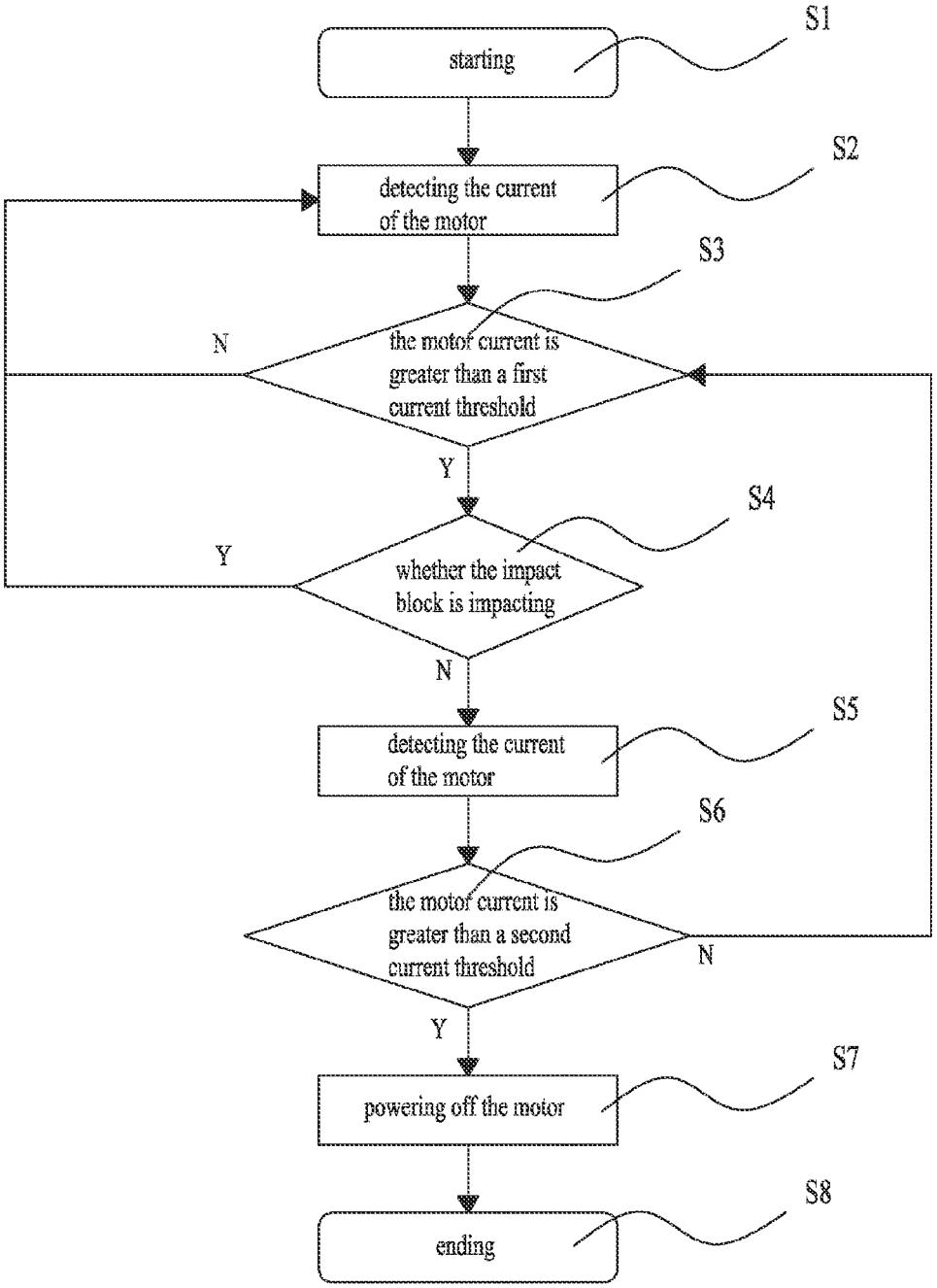
FIG. 7 is a logic block diagram of an exemplary control method according to the present disclosure.

Specifically, as a preferred embodiment and as shown in FIG. 7, the control method comprises the following steps:

S1: starting. In this step, the current of the motor 20 increases following the strength that the user pulls a trigger 60, and meanwhile the main control circuit board 50 and the detection assembly 40 are energized and operate;

S2: detecting the current of the motor 20 by the main control circuit board 50;

S3: judging the detected current value of the motor 20 by the main control circuit board 50. If the detected current value is greater than a first current threshold, step S4 is performed; and if the detected current value is smaller than the first current threshold, returning to step S2. This step is intended to ensure that the motor 20 has sufficient current to move the impact block 34 away from the first axial position so as to be detected by the detection assembly 40 when the impact block 34 is not locked;

S4: judging the detected information of the detection assembly 40 by the main control circuit board 50. If the detected information indicates that the impact block 34 is not impacting reciprocatingly, step S5 is performed; and if the detected information indicates that the impact block 34 is impacting reciprocatingly, returning to step S2; more specifically, the detection assembly 40 feeds back to the main control circuit board 50 by detecting whether the impact block 34 is at the first axial position;

S5: detecting the current of the motor 20 by the main control circuit board 50. The current detection in this step aims to achieve the control of the torque output;

S6: judging the detected current value of the motor 20 by the main control circuit board 50. If the detected current value is greater than a second current threshold, step S7 is performed; and if the detected current value is smaller than the second current threshold, returning to step S3, and the second current threshold is the preset current value. In this step, once the preset current value is satisfied, this indicates that the set torque stage has already been reached. This step is achieved by judgment of the torque through the current;

S7: controlling the motor 20 to power off by the main control circuit board 50;

S8: ending.

It should be noted here that if the judgment result of step S6 is that the detected current value is smaller than the second current threshold, returning to step S4 may also be available.

The above shows and describes basic principles, main features and advantages of the present disclosure. Those skilled in the art should appreciate that the embodiments by no means limit the present disclosure. All technical solutions obtained by employing equivalent substitutes or equivalent variations fall within the protection scope of the present disclosure.

What is claimed is:

1. A multi-purpose electric tool, comprising:

a housing;

a motor; and a transmission mechanism driven by the motor, wherein the transmission mechanism comprises:

an input shaft driven by the motor to rotate;

an impact block which rotates coaxially and synchronously only along with the input shaft when locked at a first axial position and which rotates coaxially and synchronously along with the input shaft as well as moves reciprocatingly between the first axial position and a second axial position in the axial direction when unlocked;

an output shaft driven by the impact block at the first axial position to rotate synchronously; and a locking assembly capable of locking or unlocking the impact block, and wherein the multi-purpose electrical tool further comprises:

a detection assembly configured to detect the position and the movement state of the impact block; and a main control circuit board configured to control whether the motor is powered off upon reaching a preset state according to the detected information of the detection assembly, wherein the detection assembly is electrically connected to the main control circuit board, wherein the impact block has a radially extending receiving hole with a limiting step being formed inside the receiving hole, the input shaft has a locking hole corresponding to the receiving hole in circumferential and axial positions, and the locking assembly comprises a locking pin arranged in the receiving hole and being movable in the radial direction, a limiting ring sleeved around the outer circumference of the impact block and limiting the locking pin, a spiral spring sleeved around the outer circumference of the locking pin and enabling the locking pin to move away from the input shaft, and an operating member which presses the locking pin partly into the locking hole or loosens the locking pin to allow it to completely retract out of the locking hole by its own movement.

2. The multi-purpose electric tool according to claim 1, wherein one end of the locking pin forms a semi-spherical nosetip and a limiting step against which the spiral spring abuts is provided inside the nosetip, the limiting ring has a through hole which enables the semi-spherical nosetip of the locking pin to pass there through and blocks the limiting step of the locking pin, both ends of the spiral spring respectively abut against the limiting step of the receiving hole and the limiting step of the locking pin, the operating member and the housing form a sliding connection parallel to the axial direction, the operating member comprises a press ring capable of pressing the locking pin, a connection bridge capable of loosening the locking pin to allow it to partly protrude out of the limiting ring, and a push button to be pushed or pulled by an operator's hand from the outside of the housing.

3. The multi-purpose electric tool according to claim 1, wherein the detection assembly comprises a Hall element.

4. The multi-purpose electric tool according to claim 1, wherein the detection assembly comprises one or more of a photoelectric sensor, a Hall element, or a position switch and a sound pick-up device.

5. The multi-purpose electric tool according to claim 1, wherein the preset state of the motor corresponds to a current of the motor reaching a preset current value.

6. The multi-purpose electric tool according to claim 5, wherein the multi-purpose electric tool further comprises an operation device configured, via selection of a stage, to set a preset parameter in the main control circuit board as a criterion for judging whether the preset state is reached, and the operation device is electrically connected to the main control circuit board.

* * * * *